United States Patent [19]

Layton

[11] 4,299,360

[45] Nov. 10, 1981

[54] BEAMRIDER GUIDANCE TECHNIQUE USING DIGITAL FM CODING

[75] Inventor: Allen C. Layton, Orlando, Fla.

[73] Assignee: Martin Marietta Corporation, Orlando, Fla.

[21] Appl. No.: 7,751

[22] Filed: Jan. 30, 1979

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 2,404,942 | 7/1946 | Bedford | 244/3.13 |
| 2,659,828 | 11/1953 | Elliott | 244/3.13 |
| 3,255,984 | 6/1966 | Hawes | 244/3.13 |
| 3,398,918 | 8/1968 | Girault | 244/3.13 |
| 3,501,113 | 3/1970 | Maclusky | 244/3.13 |
| 3,690,594 | 9/1972 | Menke | 244/3.13 |
| 3,782,667 | 1/1974 | Miller, Jr. et al. | 244/3.13 |
| 4,014,482 | 3/1977 | Esker et al. | 244/3.13 |
| 4,174,818 | 11/1979 | Glenn | 244/3.13 |

*Primary Examiner*—Charles T. Jordan

*Attorney, Agent, or Firm*—Julian C. Renfro; Gay Chin

[57] ABSTRACT

A beam of electromagnetic radiation is spatially encoded using a digital frequency diversity technique. The spatial encoding defines the beam cross-section into a series of resolution elements each identified by a different digital code. The codes defining resolution elements are detectable by an object, such as a missile, located in the radiation beam and can be used to locate the object in this beam. In the preferred embodiment, an encoding mask, moved through the beam, provides the digital frequency modulation. The mask is provided with a series of bit areas, each of which bears at least two sets of cyclically recurring bands effective to modulate a detectable parameter of the radiation, such as intensity. The spacing between adjacent bands of a set, termed a bit cycle, is proportional to a predetermined frequency of beam parameter modulation. The novel arrangement enables the object to identify its position within the beam under conditions of severe atmospheric turbulence and object induced perturbations.

19 Claims, 12 Drawing Figures

FIG. 5

| POSITION IN BEAM | CODE |
|---|---|
| 8T | $f_1$ $f_2$ $f_1$ $f_1$ |
| 7T | $f_1$ $f_2$ $f_1$ $f_2$ |
| 6T | $f_1$ $f_2$ $f_2$ $f_2$ |
| 5T | $f_1$ $f_2$ $f_2$ $f_1$ |
| 4T | $f_1$ $f_1$ $f_2$ $f_1$ |
| 3T | $f_1$ $f_1$ $f_2$ $f_2$ |
| 2T | $f_1$ $f_1$ $f_1$ $f_2$ |
| 1T | $f_1$ $f_1$ $f_1$ $f_1$ |
| 1B | $f_2$ $f_1$ $f_1$ $f_1$ |
| 2B | $f_2$ $f_1$ $f_1$ $f_2$ |
| 3B | $f_2$ $f_1$ $f_2$ $f_2$ |
| 4B | $f_2$ $f_1$ $f_2$ $f_1$ |
| 5B | $f_2$ $f_2$ $f_2$ $f_1$ |
| 6B | $f_2$ $f_2$ $f_2$ $f_2$ |
| 7B | $f_2$ $f_2$ $f_1$ $f_2$ |
| 8B | $f_2$ $f_2$ $f_1$ $f_1$ |

FIG. 7

| POSITION IN BEAM | CODE |
|---|---|
| 8R | $f_1$ $f_2$ $f_1$ $f_1$ |
| 7R | $f_1$ $f_2$ $f_1$ $f_2$ |
| 6R | $f_1$ $f_2$ $f_2$ $f_2$ |
| 5R | $f_1$ $f_2$ $f_2$ $f_1$ |
| 4R | $f_1$ $f_1$ $f_2$ $f_1$ |
| 3R | $f_1$ $f_1$ $f_2$ $f_2$ |
| 2R | $f_1$ $f_1$ $f_1$ $f_2$ |
| 1R | $f_1$ $f_1$ $f_1$ $f_1$ |
| 1L | $f_2$ $f_1$ $f_1$ $f_1$ |
| 2L | $f_2$ $f_1$ $f_1$ $f_2$ |
| 3L | $f_2$ $f_1$ $f_2$ $f_2$ |
| 4L | $f_2$ $f_1$ $f_2$ $f_1$ |
| 5L | $f_2$ $f_2$ $f_2$ $f_1$ |
| 6L | $f_2$ $f_2$ $f_2$ $f_2$ |
| 7L | $f_2$ $f_2$ $f_1$ $f_2$ |
| 8L | $f_2$ $f_2$ $f_1$ $f_1$ |

FIG. 9

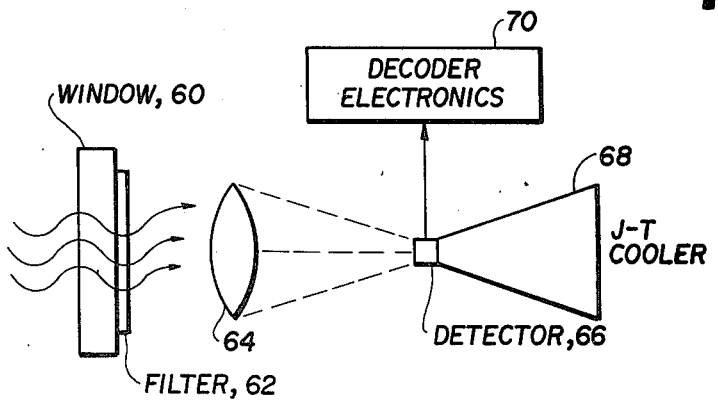

BEAMRIDER GUIDANCE TECHNIQUE USING DIGITAL FM CODING

BACKGROUND OF THE INVENTION

The invention relates to techniques and implementing apparatus for locating objects such as missiles in space and more particularly to missile guidance systems of the beam rider type.

DESCRIPTION OF THE PRIOR ART

A beamrider guidance system functions to maintain missile line of flight in a desired direction. Such systems are most readily applied to short range missile guidance problems and have found particular applications in surface to surface (primarily anti-tank) and surface to air (primarily short range air defense) missions.

A beamrider system generally includes a transmitting section and receiving section, with the receiving section being located on board the missile. In operation, an observer locates a target and projects a beam of electromagnetic radiation from the transmitter to the target. The beam of electromagnetic radiation may be viewed as a volume of radiation forming a guidance corridor to the target which, if followed by the missile, will cause it to strike at the desired location. To assure missile impact on the target, it is necessary for the missile, launched into the beam, to have its velocity vector closely aligned with the beam axis during the flight.

This task is accomplished by spatially modulating the beam at the transmitter, which modulation is detected and decoded at the missile receiver. The decoded modulation provides on board electronics with data indicative of missile position relative to the beam axis. The position data is used to generate error signals which are used by missile guidance devices to steer the missile along the beam axis. More specifically, spatial modulation of the guidance beam results in the formation of an illumination pattern over a cross-section of the beam. The illumination pattern divides the beam into a series of resolution elements, with each resolution element bearing a unique signature by reason of its modulation. The missile locates itself relative to the beam axis by detecting the modulation from the resolution element in line with its receiver.

It is known to spatially modulate the electromagnetic radiation beam of a beamrider guidance system in amplitude or frequency. Basic encoding mechanisms include analog AM, digital AM and analog FM modulation. A further encoding mechanism, which is the subject matter of my invention, may be referred to as digital FM encoding. Examples of known beam modulation techniques can be found in U.S. Pat. No. 3,690,594 to Menke, issued Sept. 12, 1972; U.S. Pat. No. 3,782,667 to Miller, Jr. et al., issued Jan. 1, 1974; U.S. Pat. No. 3,501,113 to MacLusky, issued March 17, 1970; and U.S. Pat. No. 3,255,984 to Hawes, issued June 14, 1966.

Amplitude modulation techniques for beamrider guidance systems are exemplified by the aforementioned patent to Hawes and in an embodiment of the beamrider guidance system disclosed in the aforementioned Miller, Jr. et al. patent. A beamrider guidance system which uses amplitude modulation techniques, be it analog AM or digital AM, suffers from amplitude fluctuations caused by both natural atmospheric scintillations and pertubations caused by missile wake and plume.

Known beam rider guidance systems using analog frequency modulation techniques have overcome the problems associated with amplitude modulated guidance systems. However, these frequency modulation systems are susceptible to noise problems, making frequency discrimination oftentimes difficult. An additional problem with frequency modulation type beam guidance systems are that they are complex. They often require multiple radiation sources to provide a beam having a frequency coded illumination pattern over its cross-section, as well as mechanically complicated rotating conical scanners to cause nutation of the transmitted beam which allows a single detector at the missile carried receiver to properly locate the missile relative to the beam axis. A better understanding of these complex frequency modulation guidance systems will be had upon review of the systems described in the aforementioned Miller, Jr. et al. and Menke patents.

In a conventional frequency modulation technique for spatially encoding a cross-section of a guidance beam of a beamrider system, such as that illustrated in the aforementioned Miller, Jr. et al. patent, the guidance beam is frequency divided into four quandrants by using four radiation sources each of a different frequency. The modulated radiation from the four sources are combined into a single beam having the desired spatial modulation by directing the radiation from the four radiation sources through light pipes to a light pipe common junction. The combined radiation is transmitted to nutation projection optics for transmitting the beam to the target.

The target, which may be a missile, is provided with a single detector and cooperating receiving circuitry designed to calculate the time during which each modulation frequency is received at the missile detector during a beam nutation cycle. The missile is properly aligned to the beam axis when the detector receives each frequency for the same period of time during a single nutation cycle. The above described system may be termed an analog frequency modulation beam guidance system.

Another technique for providing analog frequency modulation to a guidance beam of a beamrider guidance system is illustrated in the aforementioned Menke patent. Menke develops frequency modulation of a guidance beam by nutating a rotating disc divided into a number of radiation transmitting pie-shaped sections and a like number of alternately arranged radiation opaque pie-shaped sectors. The sectors are shaped in the described manner so that the width of each sector at a point close to the disc center is less than the sector width at the disc perimeter. The disc is rotated in the path of a guidance beam thereby imparting frequency modulation to the beam. More specifically, the rotating disc functions to chop the guidance beam such that the rotating disc projects an image pattern across the beam cross-section, which pattern may be visualized as a series of different frequency divisions extending across the beam cross-section. When the rotating disc is nutated, a single detector only is required for locating the missile relative to the beam axis.

The present invention is directed to an improved beam rider guidance system using frequency modulation techniques for spatially encoding the guidance beam. As will become evident from a reading of a description of the invention set out hereinafter, the improved guidance system which uses digital frequency modulation encoding eliminates the complexity of known FM type beam guidance systems while maintaining the advantages of frequency modulation type guidance systems over amplitude modulation type guidance systems. Digital frequency modulation encoding also provides the advantage that is has reduced susceptibility to atmospheric turbulence and missile induced pertubations.

SUMMARY OF THE INVENTION

It is a primary object of the present invention to apply digital techniques to beamrider type missile guidance systems.

It is a further object of this invention to combine digital encoding concepts with frequency modulation techniques for spatially encoding a guidance beam of a beamrider guidance system.

A still further object of the present invention is to provide an electromagnetic radiation beam guidance system which spatially encodes a guidance beam cross-section to develop a large plurality of resolution elements, each resolution element being uniquely designated by a digital code affected by frequency modulating the radiation in each resolution element according to a different digital word.

These and other objects as set out hereinafter are accomplished by an electromagnetic radiation beam guidance system which includes a beam transmitting apparatus having one or more encoding masks. The encoding masks are divided into a plurality of bit areas, with each bit area being comprised of cyclically recurring, spaced apart bands which are effective to vary a detectable beam characteristic. For example, the bands may take the form of transmitting regions with the areas between the bands being opaque to the radiation. The bands are spaced from each other by preselected distances, with the distance from the leading edge of a band to the leading edge of the next succeeding band being defined herein as a bit cycle. Means are provided for moving the encoding mask through the guidance beam whereby the beam is modulated at a frequency or frequencies determined by the spacings between the bands of the bit areas. That is, the modulation frequencies are determined by the dimensions of the bit cycles.

To develop orthogonal, such as vertical and horizontal, positional information, two encoding masks are used. To provide vertical position information, one encoding mask is divided into a plurality of rows, the rows defining vertical resolution elements. Each row is comprised of a plurality of bit areas of sufficient number to uniquely designate each of the resolution elements. Specifically, N bit areas will uniquely define $2^N$ resolution elements. For example, if each resolution element is defined by four bit areas, then sixteen resolution elements can be uniquely designated.

For a vertical position encoding mask, each bit area may be defined by vertically disposed pattern of cyclically recurring, vertically oriented light transmitting bands with the bands within each pattern being spaced from each other in a horizontal direction by a predetermined distance proportional to a given frequency. The given frequency defines a logic level. As previously mentioned, the distance between the leading edge of a light transmitting band and the leading edge of the succeeding band is termed herein a bit cycle. Thus, each pattern is comprised of a plurality of bit cycles.

In a two logic level system, each bit area will have at least two rows of bit cycles, with the dimension of the bit cycle of one row being different from that of the other row. That is, each bit area will have at least two patterns of cyclically recurring bands, with the adjacent bands within each pattern being spaced apart by one of two predetermined distances. One predetermined distance will be proportional to the frequency $F_1$ and the other to the frequency $F_2$. As the vertical position encoding mask is moved through the guidance beam, the beam radiation is chopped at frequencies determined by the bit cycle dimensions, that is, the horizontal spacing between the bands of the bit areas, thereby defining resolution elements. Each bit area, as it moves through the beam, can simultaneously generate a plurality of spaced apart bits, each bit being one bit of a digital word defining a resolution element. Thus, radiation passing through a resolution element defined by the bit signature $F_1F_1F_2F_1$ will be chopped first at the frequency $F_1$ as the first bit area of the encoding mask passes through the beam, then at the frequency $F_1$ while the second bit area passes through the beam, then at the frequency $F_2$ while the third bit area of the resolution element passes through the beam, and finally, at the frequency $F_1$ while the fourth bit area of the resolution element passes through the beam. By providing each bit area with several spaced apart sets of cyclic recurring bands, several resolution elements are simultaneously identified.

The missile receiver detects the frequency modulation which defines the resolution element which is in the line of sight to the missile detector and converts this information into a digital code for use in locating the missile relative to the beam axis and for initiating correction guidance when necessary.

The horizontal position encoding mask, like the vertical position encoding mask, defines a plurality of resolution elements, through the use of a plurality of bit areas. To develop horizontal position information, the resolution elements appear as a series of columns defined by successively passing each bit area vertically through the radiation beam. Each bit area carries patterns of cyclically recurring horizontally oriented beam modulating bands vertically separated from each by a predetermined distance defining a modulation frequency. The horizontal position encoding mask is moved vertically through the guidance beam to chop the beam at rates determined by the band spacings of the bit areas.

The vertical and horizontal position encoding masks are moved, one at a time, through the guidance beam to provide the missile guidance equipment with vertical and horizontal data relative to the beam axis. Thus, I have provided a spatial encoder for establishing the position of a receiver within a beam of electromagnetic energy by providing digital, orthogonal position information via frequency modulation of the electromagnetic energy.

BRIEF DESCRIPTION OF THE DRAWINGS

FIG. 5 is a table of digital code words corresponding to designated vertically disposed resolution elements;

FIG. 7 is a table of digital code words corresponding to designated horizontally disposed resolution elements;

FIG. 9 is a diagramatic representation of receiver equipment which can detect and decode a beam of electromagnetic radiation encoded according to the teachings of the invention.

DETAILED DESCRIPTION OF THE PREFERRED EMBODIMENT

Figure 1:
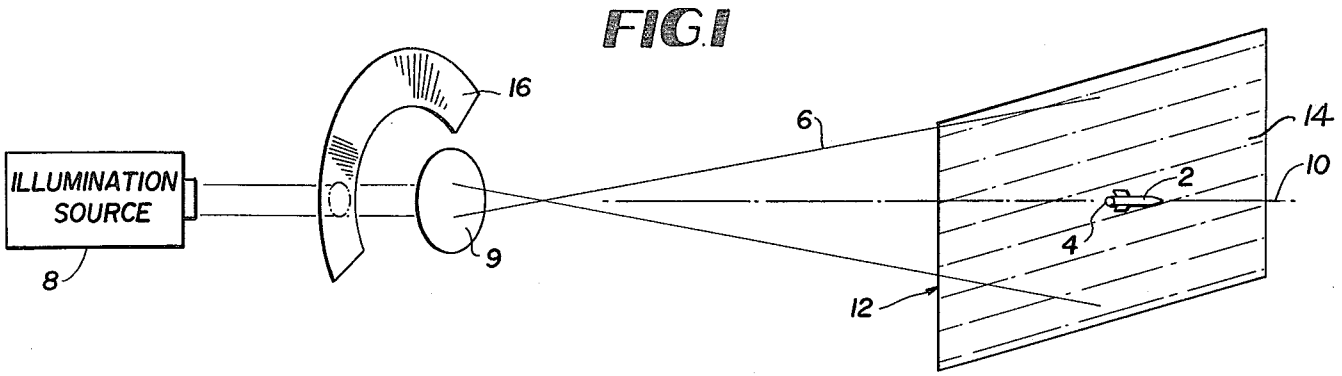
FIG. 1 is a diagrammatic representation of a radiation beam encoding apparatus constructed according to the teachings of the present invention.

The subject invention may be better understood by referring to FIG. 1 which illustrates the inventive concept. This figure illustrates a missile 2, with a detector 4 at its aft end, flying in a beam of electromagnetic radiation 6 emitted from a source 8 and passing through a projection lens 9. The beam has a central axis 10. A cross-section 12 of the radiation beam is shown having an image pattern comprised of a series of horizontally arrayed resolution elements 14 defining a vertical position, which may be formed by passing an encoding mask 16 horizontally through the beam.

That is, considering that encoding mask 16 is moving in a vertical plane, and the line of sight of the viewer is in a horizontal plane, the cross-section 12 of the radiating beam is shown having an image pattern comprising a series of horizontally disposed resolution elements arrayed in a vertical plane and defining an azimuth position with respect to the beam axis.

In my preferred embodiment, I have used a curved encoding mask having bit areas comprised of spaced apart patterns of cyclically recurring bands of radiation transmitting regions, the spacing between adjacent bands being radiation blocking. My invention is not to be construed as being limited to the specific mask configuration illustrated.

Figure 4:
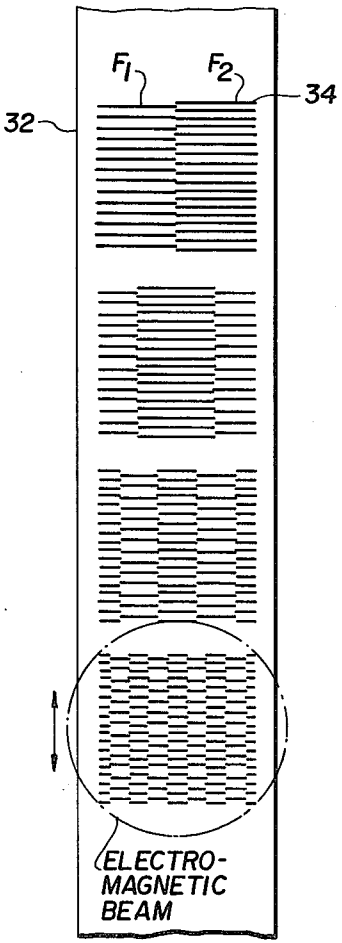
FIG. 4 illustrates the mask of FIG. 2 positioned to develop horizontally disposed resolution elements across a beam cross-section.

More generally, my invention contemplates a mask having a plurality of bit areas defined by spaced apart sets of cyclically recurring regions effective to alter a detectable parameter or characteristic of the radiation beam. For example, the bit areas may be comprised of sets of cyclically recurring wavelength filters. The mask need not be curved, and it may be formed into any convenient shape such as elongate strips as illustrated in FIGS. 2 and 4.

Even more broadly, my invention involves spatially encoding a beam of radiation by frequency modulating the beam in accordance with a digital code. The modulation technique operates to divide the beam cross-section into resolution elements each identified by a different digital word. Each bit of a digital word may be identified by a frequency. A resolution element is given its unique digital signature by varying the detectable parameter of the beam at the frequencies defining the bits of the digital word designating the resolution element. Instead of using an encoding mask, a plurality of radiation sources may be used, each corresponding to a different resolution element. The sources may be modulated in accordance with the digital word identifying the resolution element with which the source is associated, to provide the resolution element with its detectable signature.

Figure 2:
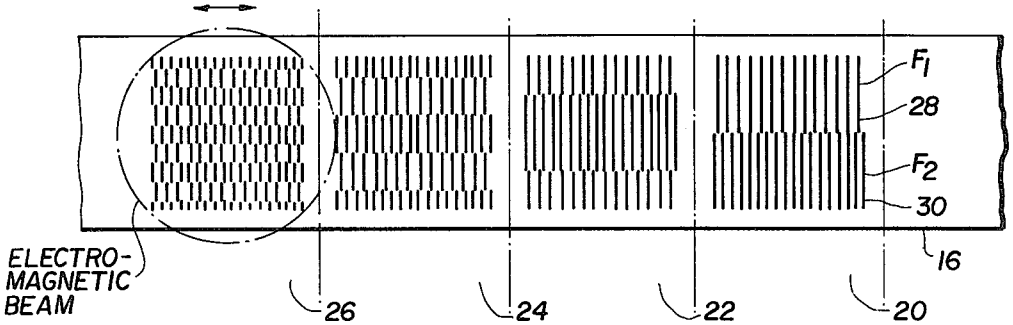
FIG. 2 illustrates an encoding mask for the digital, frequency encoding of a radiation beam in accordance with the teaching of the invention, the mask being configured to develop vertically disposed resolution elements across a beam cross-section.

Returning to my preferred embodiment, which makes use of an encoding mask, FIG. 2 illustrates in greater detail a typical encoding mask usable with my invention. The encoding mask 16 is divided into a series of bit areas 20, 22, 24 and 26 with each bit area including two or more sets 28 of vertically disposed radiation transmitting bands 30.

Figures 3A, 3B, 3C, 3D:
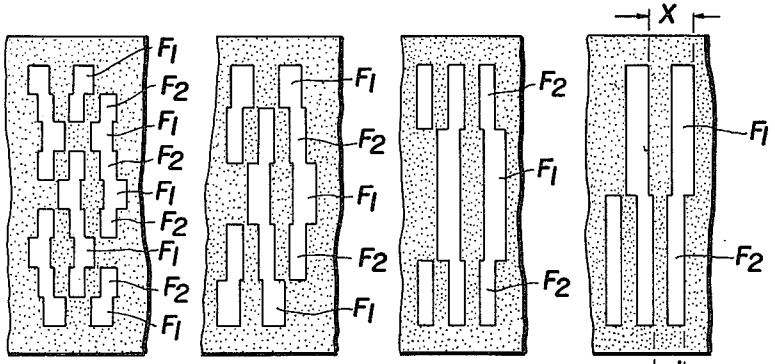
FIGS. 3*a*–3*d* illustrate examples of masks used in order to produce modulation frequencies utilized in the position code, and several bit details for the bit areas of the mask of FIG. 2.

FIG. 3*a* represents an enlargement of typical detail as shown at 20 in FIG. 2, with it to be noted that distance X in FIG. 3*a* is defined as a bit cycle.

The bit cycle dimension, that is, the spacing between the radiation transmitting bands 30, is pre-selected to be proportional to a predetermined frequency. As the encoding mask is moved through the beam at a constant rate, each bit area, one at a time, will successively pass through the beam causing it to be chopped at frequencies determined by the spacing between the radiation transmitting bands of the band sets 28 in registration with the beam. More specifically, as bit area 20 moves through the beam, the top half of the beam is chopped at frequency $F_1$ while the bottom half is chopped at frequency $F_2$. As the mask 16 continues to move through the beam, bit area 22 moves into registration with the beam. The top quarter and bottom quarter of bit area 22 contain radiation emitting bands spaced from each other by a distance proportional to the frequency $F_2$. The middle half of bit area 22 bears radiation transmitting bands spaced at a distance proportional to $F_1$. Thus, as bit area 22 moves through the beam, the top and bottom quarters of the beam cross-section are chopped at the frequency $F_2$ while the central portion of the beam cross-section is chopped at the frequency $F_1$. As will be apparent, the use of a single bit area 20 divides the beam cross-section into two resolution elements. When an encoding mask is provided with two bit areas 20 and 22, the beam cross-section may be divided into four resolution elements. In the latter case the top most resolution element is identified by the digital frequency code $F_1$, $F_2$, the following resolution element by the digital frequency code $F_2$, $F_2$ and the lowest most resolution element by the digital frequency code $F_2$, $F_1$.

The number of resolution elements into which a beam cross-section can be divided is dependent upon the number of bit areas. Generally, the number of resolution elements which may be realized is equal to $2^N$ where N equals the number of bit areas. FIG. 2 illustrates an encoding mask divided into 4 bit areas 20, 22, 24, and 26 which provides 16 resolution areas. It should be noted at this time that the encoding mask 16 of FIG. 2 is used to provide vertically disposed resolution areas which are used to provide the missile 2 with elevation data relative to the beam axis 10.

FIGS. 3*a* through 3*d* represent, respectively, examples of the bit details for the bit areas 20,22,24 and 26 of FIG. 2. Each bit area will contain a plurality of the bit details illustrated. For example, each bit area may include a bit detail repeated ten times. That is to say, each bit area may be comprised of ten bit cycles. While each bit area may, of course, include a greater or lesser number of bit cycles as circumstances require, I have found that bit areas containing ten bit cycles each will be adequate to define the digital signature of a resolution element.

Referring to FIG. 3*a*, which represents the bit detail for bit area 20, the dimension X, as previously mentioned, is defined as a bit cycle for frequency $F_1$ and the dimension $X^1$ defines a bit cycle for the frequency $F_2$. The bit cycle dimensions X and $X^1$, defining frequencies $F_1$ and $F_2$, will be the same for each bit area of the vertical resolution mask 16. As will be explained below with reference to FIG. 4, the horizontal resolution mask 32 may be configured with bit details identical to that used in mask 16. While the bit cycles for the vertical resolution mask 16 and horizontal resolution mask 32 may be of the same dimensions, it has been found advantageous to change the bit cycle dimensions of one mask relative to the other. For example, the bit cycle dimensions of one mask may be twenty percent larger than those of the other.

To provide the missile with orthogonal data concerning its azimuth relative to the beam axis, the second encoding mask 32 illustrated in FIG. 4 is provided. The mask 32 is moved vertically through the beam 6 to produce columns of resolution elements. Mask 32 is similar in construction to mask 16 except that the radiation transmitting bands 34 are positioned horizontally with respect to the beam. When the encoding mask is designed as a curved strip or as a linear strip as illustrated in FIGS. 2 and 4, the mask 16 and 32 can be identical, insofar as construction goes. Vertical position resolution elements in the form of rows of resolution elements are therefore developed by moving the mask 16 horizontally through the beam, while horizontal position resolution elements in the form of columns of resolution elements are developed by moving the mask 32 vertically through the beam. It is also possible to use different frequency sets for the two orthogonal directions, i.e., elevation and azimuth. Frequencies $F_1$ and $F_2$ can be used to designate vertical position resolution elements while frequencies $F_3$ and $F_4$ may be used to designate horizontal position resolution elements. This allows the receiver to easily differentiate between elevation and azimuth information. Frequencies $F_3$ and $F_4$ may be generated using the same bit details illustrated in FIGS. 3*a* through 3*d* with only the bit cycle dimensions being enlarged or reduced.

As should now be apparent, a preferred embodiment of this invention utilizes one or more chopper masks which serve to produce digital frequency modulation as they are caused to move through the cross-section of a projection beam. Preferably, two chopper masks which move sequentially through the cross-section of the beam are used. One of such masks should contain position information which is orthogonal to the position information with respect to the beam axis, that is contained on the other mask.

My invention is not limited to operate with a particular electromagnetic beam generating apparatus and any of various conventional beam generating devices may be employed. The beam source may be, for example, a light source such as a laser combined with a suitable projection lens. The encoding mask would be located between the source and the lens to chop the light prior to its projection. A more detailed description of a suitable beam generating apparatus is to be set out hereinafter.

Missile 2 is provided with receiving equipment which includes a detector 4 responsive to the radiation emitted by the source 8. While the order in which the cross-section is encoded is generally immaterial, it will be assumed that the beam is first encoded into vertical position resolution elements and then into horizontal position resolution elements. Thus, the detector first receives a digital frequency code corresponding to the vertical position resolution element 14 which is in its line of sight. This digital frequency code may be converted into a position code for processing by the on-board guidance correction circuitry. For purposes of illustration it will be assumed that the missile detector is in line with the top most resolution element identified by a two bit code $F_1$, $F_2$. This code will be defined as corresponding to the digital word 01. The receiver, upon receiving the digital frequency code $F_1$, $F_2$ converts it into a digital word 01 which may be represented by different voltage levels. This word is processed by the missile guidance correction circuitry to relocate the missile towards the beam axis. Horizontal position correction is accomplished in a like manner using a horizontal position encoding mask of FIG. 4. A more detailed description of a preferred embodiment of the missile receiver equipment is set out hereinafter.

It has been determined that excellent guidance information can be developed using a four bit code which defines 16 resolution elements in each of two orthogonal directions. Such a four bit encoding mask is illustrated in FIG. 2. FIG. 5 sets out the guidance codes for each of the 16 resolution elements defined by the mask of FIG. 2. Positions labeled T and B correspond to top and bottom positions, respectively, with regard to the beam axis. The guidance axis relative to elevation is at the boundary between the positions 1T and 1B in FIG. 5.

Figure 6:
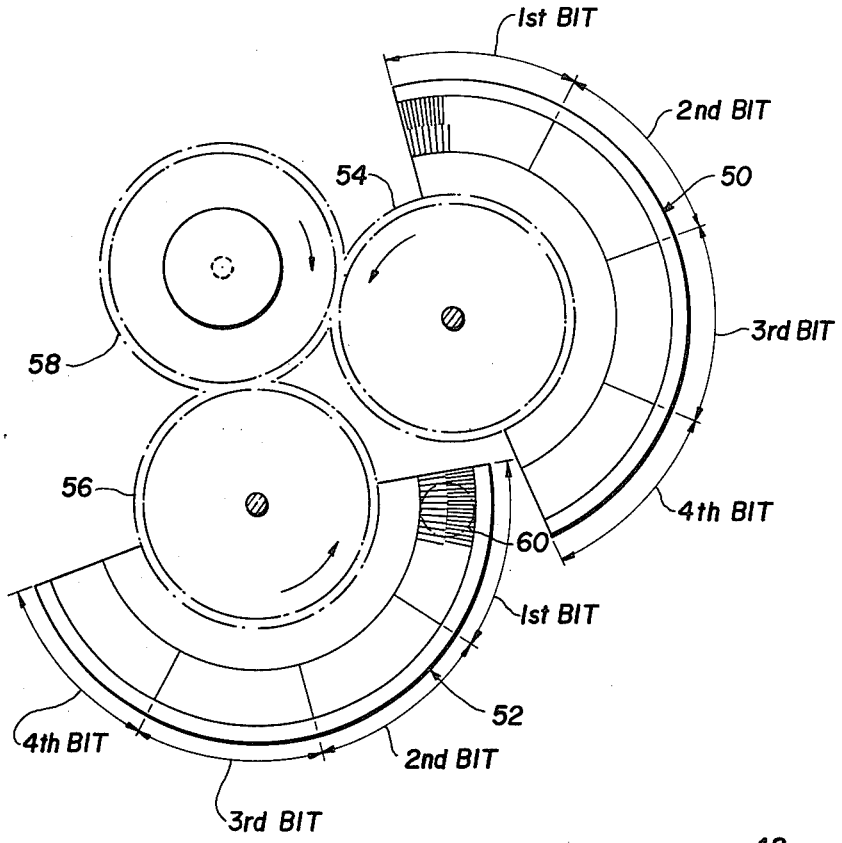
FIG. 6 shows a preferred embodiment of the encoding mask of my invention, which embodiment is an encoder wheel.

In my preferred embodiment, the encoding masks are implemented by an encoder wheel as illustrated in FIG. 6. The encoder wheel is comprised of a vertical resolution encoder wheel segment 50, and a horizontal encoder wheel segment 52. Each encoder segment is attached by any suitable means to a respective drive gear 54, 56. The vertical drive gear 54 and horizontal drive gear 56 are preferably driven by a single motor. To this end, main drive gear 58, coupled to the motor (not shown), engages the vertical and horizontal drive gears 54, 56. The encoder segments 50,52 each occupy less than 180°. In this way they may be made to rotate, preferably one at a time, through the electromagnetic beam 60, with there being no overlapping of the segments 50, 52 in the area of the beam 60. Rotation in this instance may be in the direction of the arrows appearing on members 50 and 52 in FIG. 6.

The bit details of the bit areas of the encoder segments 50,52 may take the form shown in FIGS. 3*a* through 3*d*. To aid in understanding the separation of the encoder segments of FIG. 6, suggested bit details for the first bit positions of the vertical and horizontal encoder segments 50,52 are illustrated. It is again noted that if desired, the bit cycle dimensions of the vertical encoder segment may be different from that of the horizontal encoder segment.

Looking at the first bit position of the horizontal encoder segment 52 as illustrated in detail in FIG. 3*a*, it is seen that the inner portion of the encoder segment at the first bit position has wider spaces than the outer portion. The wider spaces will produce a lower frequency modulation of the beam while the narrower spaces of the outer portion will produce a higher frequency modulation. The second bit area as illustrated in FIG. 3*b* will produce a narrower, higher frequency modulation on the leftmost and rightmost quarters of the beam and wider, lower frequency modulation on the center half of the beam. This is because the leftmost and rightmost quarters are modulated at frequency $F_2$ and the center section at frequency $F_1$. The encoding sequence for the third and fourth bits of segment 52 may be as shown in detail in FIGS. 3*c* and 3*d*. The sequence of frequencies generated by the encoder wheel of FIG. 6 corresponds to the table in FIG. 7, with the positions labeled R and L corresponding to positions to the right and left of the beam axis. Resolution element 8L is closest to the wheel hub while resolution element 8R is closest to the outer edge of the wheel. It is to be understood that the frequency sequence given in the tables of FIGS. 5 and 7 are for illustration purposes only. It is obvious to one skilled in the art that other alternatives codes could be devised using the basic concept of a series of discrete frequencies to digitally encode a guidance beam. Simple alternatives include exchanging frequencies $F_1$ and $F_2$ in all bit areas or reversing the order of the resolution elements. Completely unrelated codes are also possible.

I have found that garbling tends to occur and net energy transmission is reduced if the information appearing on one encoder segment or track is transmitted simultaneously with the information appearing on the other encoder segment or track, so I prefer for each of the wheels 50 and 52 to extend less than 180 degrees, and to rotate without their information containing portions contacting each other. It is also preferred for one wheel to present all of its information, and then for the other wheel to present its information, without interleaving taking place, although this latter could be restored to if desired. I also prefer for each bit of information to be transmitted from the precise focal plane of the associated projection optics, and this of course is simplified by utilizing the arrangement shown in FIG. 6 wherein the wheels 50 and 52 rotate in a timed, non-interfering relationship with each other.

Figure 8:
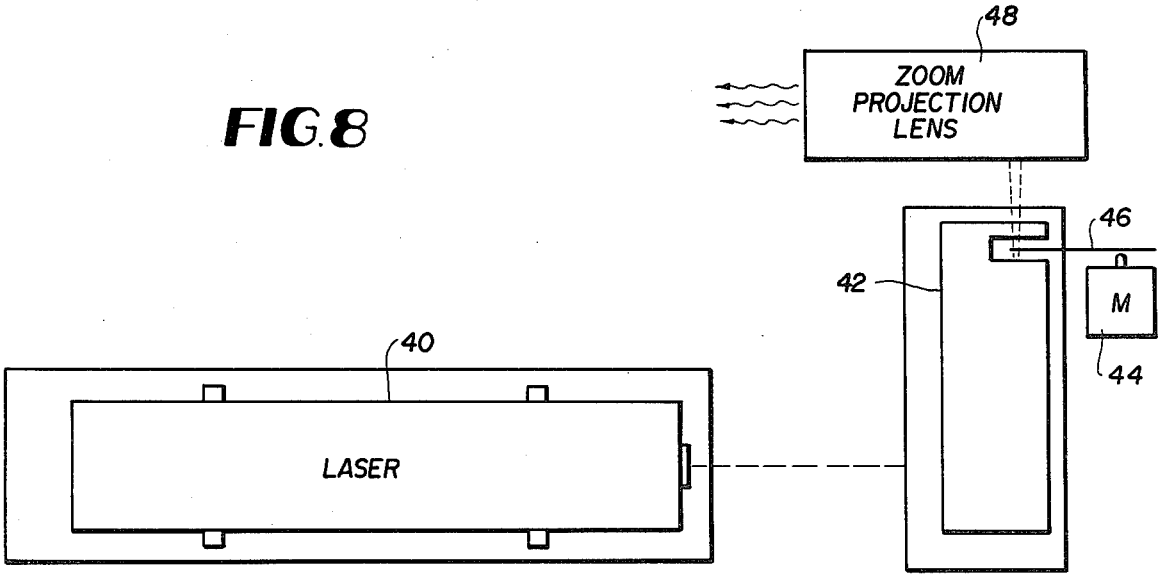
FIG. 8 illustrates a preferred embodiment of the equipment for projecting a beam of electromagnetic radiation encoded in accordance with the teachings of the present invention.

FIG. 8 illustrates a preferred embodiment of the beam forming and encoding apparatus required for a digital FM code in accordance with the teachings of the present invention. One component is the source of electromagnetic radiation which is illustrated in FIG. 8 as a laser source 40. It is understood that in the most general embodiment of the subject invention a laser is not required and that any source of electromagnetic radiation having the desired wave length and intensity could be used. For example, it would be possible to implement the system of the present invention with a Xenon arc lamp as the source of radiation. The major reason for choosing a laser as the source is the monochromatic nature of the laser radiation. This allows all the optics to be designed with no color correction and allows the receiver to discriminate against spurious broad band signals caused by the sun and by the rocket motor plume if the system is employed as a missile guidance technique. Additionally, the inventive technique is not limited to being used with a single laser type but may be employed with any laser that produces sufficient power for the desired application. My preferred embodiment utilizes a $CO_2$ laser because the $CO_2$ laser exhibits superior transmission through atmospheric conditions such as haze and smoke. An example of a typical $CO_2$ laser that could be utilized with this type of guidance technique is the commercially available model 941 made by GTE Sylvania.

A second major component of the beam generating equipment is the condenser optics 42. The function of this set of optics is to take the source of radiation and form it into the proper size and shape to illuminate the encoder 46. With a laser source the condenser optics can take the form of a beam expander which takes a circularly symmetrical laser beam and increases its diameter to a size sufficient to illuminate the encoder. Beam expanders of this type are commercially available. For example, a model BECZ10.6 Cl.4:10-D5 made by II-VI, Inc. could be utilized. Other forms of condenser optics known in the art could also be used.

As illustrated in FIG. 8, a motor 44 drives an encoder 46, which may correspond to the encoding wheels of FIG. 6, through the expended laser beam. The laser beam then enters the projection optics 48. The projection optics functions to relay the image of the encoder to the plane of the receiver. In a missile system, the distance to the receiver located in the missile is constantly increasing during missile flight. It is desirable for the image in the receiver plane to remain a constant size. The missile then can have a constant gain for a given error and similar accuracy at any range. To maintain the image size constant, the projection optics may include a motor driven zoom lens. The focal length of the zoom lens could be programmed to increase at a rate consistent with missile velocity, and therefore, the beam diameter remains constant at the missile. With such a system the zoom ratio would be determined by the range over which the system must be used. For example, if the guidance must maintain accuracy between 1 km and 5 km then a 5:1 zoom ratio is required. The focal length and aperture size of the lens would be selected for each application. It should be obvious to those skilled in the art that the specific projection system illustrated is but one of any number of projection systems which may be used without departing from the spirit or scope of my invention. The specific projection scheme will depend upon the specific application.

When the beam of electromagnetic radiation is in a form of a laser beam, the receiver components on the missile are similar to those used with any laser beam-rider system operating at a given wavelength. The only exception is the decoder electronics which must be tailored to operate with the system's particular code.

In general, as illustrated in FIG. 9, the receiver optical system consists of a receiver window 60 with a narrow band optical filter 62 deposited on its rear surface. Behind the receiver window is a collector lens 64 and a suitable detector 66 such as a HgCdTe detector. The detector may be mounted on a Joule-Thomson cooler 68. The cooler 68 is generally used when the received radiation is in the long wave infrared region. However, the cooler would not be necessary if the received radiation is in the near infrared region.

Both the window and the lens may be made of germanium if the received radiation is in the long wave infrared region and all surfaces except that having the narrow band pass filter are anti-reflection coated for the desired wave length. The lens 64 is preferably set at a shorter distance than the on axis focal length. This setting spreads the radiation over a larger area to avoid the effects of point-to-point changes in detector response. It also allows more of the off axis rays to be intercepted by the detector and avoids the requirement for precision focus of the lens on the detector surface.

The signal from the detector is sent to the decoder electronics 70 which may include a pre-amplifier and postamplifier stage. Depending upon the application, the postamplifier can be automatically gain controlled to raise the signal level above a clipper level. The clipper is not intrinsic to the system, but it does remove amplitude scintillation noise. The ability to amplify and clip is an advantage of frequency modulation systems and is not an option available in amplitude modulation systems. After amplification, frequency discriminators set for the known code frequencies are used to determine the sequence of frequencies. Once the sequence is determined a simple digital logic is used to determine the receiver position with respect to the beam center. The output of this logic can be either a voltage proportional to position which can be displayed or sent to an auto-pilot for guidance or a digital output for use with digital signal responsive guidance equipment. The exact nature of this output is flexible and is determined by the specific system requirements.

While my invention has been disclosed with reference to a preferred embodiment, it is to be understood that it should not be construed to be limited to the specific embodiment described. Various modifications may be made to the details of the described embodiment without departing from the spirit and scope of my invention. For example, and without limitation, the illustrated mask and bit detail configurations are exemplary only and may be configured in any other suitable way.

I am not to be limited to the use of masks containing appropriate combinations of clear and opaque regions responsible for producing the frequency modulation information to which the missile receiver is responsive, and for example it may be practical instead of masks to utilize a number of GaAs diode lasers, and to assign one of such lasers to each resolution element. For example, an array of say 256 GaAs lasers could be utilized, with each laser modulated to produce the selected digital FM Code by changing its excitation current. A digital switching network would be used to switch the current to the lasers in such a way as to produce modulation formats analogous to, if not identical to, the chopper disc modulation formats.

What is claimed:

1. An encoding mask for use in conjunction with an electromagnetic beam of radiation for spatially encoding the beam as the mask is moved through the beam at a constant, predetermined speed to thereby facilitate the locating of an object in space, comprising:

a surface having a series of adjacent regions defining bit areas, each of said regions being defined by at least two sets of spaced apart cyclically recurring bands effective to vary a detectable beam parameter, the spacing between adjacent bands of a set being preselected to produce a predetermined beam modulation frequency as the surface is moved through the beam, the spacing between adjacent bands of one set of bands within a bit area being different from the spacing between adjacent bands of at least one other set of bands within the same bit area to thereby spatially modulate the beam at two frequencies, at least, as a bit area is moved through the beam.

2. In the encoding mask as set out in claim 1 wherein said bands alter the intensity of the radiation passing there-through relative to the intensity of the radiation passing through the regions between adjacent bands.

3. In the encoding mask as set out in claim 1 wherein said bands alter the wavelength of radiation passing therethrough relative to the radiation pass band of the regions between adjacent bands.

4. In the encoding mask as set out in claim 1 wherein said bands alter the polarization of radiation passing therethrough relative to the radiation passing through the regions between adjacent bands.

5. In the encoding mask as set out in claim 1 wherein said surface is generally rectangularly shaped with a plurality of bit areas being sequentially positioned along the length of the surface.

6. In the encoding mask as set out in claim 1 wherein said surface is curved, said bit areas being located about the surface circumference, with the different sets of spaced apart radiation transmitting bands being radially disposed within each bit area.

7. A system for encoding a beam of electromagnetic radiation in a manner whereby the beam cross-section is spatially encoded to define resolution elements which are detectable by an object to locate itself within the beam, comprising:

a source of electromagnetic radiation, projection means for producing a beam of radiation in response to radiation from said source, and means for spatially modulating said beam by the use of at least two fixed, discrete frequencies so as to convey an array of digital words which resolve positions within the beam into unique discrete locations.

8. In the encoding system according to claim 7 wherein said spatial modulation means includes means for frequency modulating the beam of radiation in accordance with a digital code whereby said beam is spatially encoded into resolution elements, each of which is identified by a different digital word.

9. In the encoding system according to claim 8 wherein said spatial modulation means includes a plurality of electromagnetic radiation sources and means for frequency modulating the radiation intensity of each of said sources in accordance with a digital word to define said spatially separated resolution elements.

10. A system for encoding a beam of electromagnetic radiation in a manner whereby the beam cross-section is spatially encoded to define resolution elements which are detectable by an object to locate itself within the beam, comprising:

a source of electromagnetic radiation, projection means for producing a beam of radiation in response to radiation from said source, and means for spatially modulating said beam in accordance with a digital code, said spatial modulation means including an encoding mask defining at least one bit area comprising a plurality of cyclically recurring regions effective to vary a detectable beam parameter, said regions being spaced apart by a distance proportional to a predetermined frequency determined by the rate at which the bit area moves through the beam, and means for moving said bit area of the mask through the beam of radiation at a selected rate to vary the radiation at said predetermined frequency.

11. In the encoding system according to claim 10 wherein said detectable parameter is beam intensity and said regions are bands of light transmitting areas spaced apart by light blocking areas.

12. In the encoding system according to claim 10 wherein said spatial modulation means includes two encoding masks for modulating the beam in two orthogonal directions.

13. In the encoding system according to claim 10 wherein said encoding mask is an encoding wheel or a segment of an encoding wheel.

14. In the encoding system according to claim 11 wherein said encoding mask includes a plurality of bit areas, each bit area having at least two special sets of light transmitting bands, the spacing between the bands of one set being different from the spacing between bands of at least one other set to thereby simultaneously modulate the beam of radiation at two different repetition rates, at least, as a bit area of the mask is moved through the beam.

15. In the encoding system according to claim 14 wherein said encoding mask includes N bit areas, said bit areas being provided with sets of light transmitting bands to defined $2^N$ resolution elements.

16. In the encoding system according to claim 10 wherein said source of electromagnetic radiation is a source of laser energy, and further comprising optic means for sizing the source radiation to uniformly illuminate at least a portion of a bit area of said encoding mask and projection means for relaying the encoded radiation as a radiation beam of preselected dimension and intensity.

17. A system for locating an object relative to its position in a beam of electromagnetic radiation and including means for spatially encoding the radiation beam into resolution elements which can be detected by the object to provide it with position information, comprising:

a source of electromagnetic radiation, projection means for producing a beam of radiation which can be received by the object, means for frequency modulating the said beam intensity in accordance with a digital code, each resolution element being identified by a different digital word, means for spatially modulating said beam by the use of at least two fixed, discrete frequencies so as to convey an array of digital words which resolve positions within the beam into unique discrete locations, and receiver means carried by said object for detecting said digital words to provide said object with an indication of its position relative to said resolution elements.

18. In the system as claimed in claim 17 wherein said receiver means includes detector means responsive to the beam radiation, and decoder means responsive to said detector means for decoding the received digital, frequency modulation received by the detector means.

19. In the system as claimed in claim 18 wherein said frequency modulating means includes an encoding mask having at least one bit area for movement through said beam, said bit areas comprising spaced apart means for simultaneously and cyclically varying a beam characteristic of at least two different repetition rates to define at least two resolution elements.

* * * * *